US011333313B2

(12) United States Patent
Zhu et al.

(10) Patent No.: US 11,333,313 B2
(45) Date of Patent: May 17, 2022

(54) VEHICLE LAMP MODULE AND VEHICLE USING SAME

(71) Applicant: HASCO VISION TECHNOLOGY CO., LTD., Shanghai (CN)

(72) Inventors: He Zhu, Shanghai (CN); Zhiping Qiu, Shanghai (CN); Cong Li, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/426,354

(22) PCT Filed: Nov. 12, 2019

(86) PCT No.: PCT/CN2019/117369
§ 371 (c)(1),
(2) Date: Jul. 28, 2021

(87) PCT Pub. No.: WO2020/173129
PCT Pub. Date: Sep. 3, 2020

(65) Prior Publication Data

US 2022/0099264 A1 Mar. 31, 2022

(30) Foreign Application Priority Data

Feb. 26, 2019 (CN) ..... 201910144380.9

(51) Int. Cl.
*F21S 41/25* (2018.01)
*F21S 41/147* (2018.01)
(Continued)

(52) U.S. Cl.
CPC ..... *F21S 41/25* (2018.01); *F21S 41/147* (2018.01); *F21S 41/285* (2018.01);
(Continued)

(58) Field of Classification Search
None
See application file for complete search history.

(56) References Cited

FOREIGN PATENT DOCUMENTS

CN 107366870 A 11/2017
CN 207674343 U 7/2018
(Continued)

OTHER PUBLICATIONS

PCT/CN/2019/117369, International Search Report dated Feb. 6, 2020, 8 pages.
(Continued)

*Primary Examiner* — Elmito Breval
(74) *Attorney, Agent, or Firm* — Meunier Carlin & Curfman LLC

(57) ABSTRACT

A vehicle lamp module and a vehicle using same. The vehicle lamp module comprises: a low beam circuit board (1), a low beam reflector (2), a high beam circuit board (3), a high beam condenser (4), a heat radiator (5), a lens (6), a lens support (7), and a module support (8), wherein the low beam reflector (2) serves as an optical element for forming a low beam shape, and the high beam condenser (4) serves as an optical element for forming a high beam shape. The vehicle lamp module has a good light shape uniformity, good low beam visibility, good high beam lighting performance, and excellent heat dissipation performance. Moreover, the module has a relative simple structure, a light weight, a small volume, a low cost, and a good comprehensive performance.

20 Claims, 5 Drawing Sheets

(51) Int. Cl.

| | |
|---|---|
| ***F21S 41/20*** | (2018.01) |
| ***F21S 41/67*** | (2018.01) |
| ***F21S 41/32*** | (2018.01) |
| *F21W 107/10* | (2018.01) |
| *F21Y 115/10* | (2016.01) |
| *F21W 102/13* | (2018.01) |

(52) U.S. Cl.
CPC ..... *F21S 41/321* (2018.01); *F21S 41/67* (2018.01); *F21W 2102/13* (2018.01); *F21W 2107/10* (2018.01); *F21Y 2115/10* (2016.08)

(56) References Cited

FOREIGN PATENT DOCUMENTS

| | | | |
|---|---|---|---|
| CN | 108930953 | A | 12/2018 |
| CN | 208295797 | U | 12/2018 |
| CN | 109681843 | A | 4/2019 |
| JP | 2015170388 | A | 9/2015 |
| JP | 2018097914 | A | 6/2018 |

OTHER PUBLICATIONS

PCT/CN/2019/117369, Written Opinion of the International Searching Authority dated Feb. 6, 2020, 5 pages.

VEHICLE LAMP MODULE AND VEHICLE USING SAME

CROSS-REFERENCE TO RELATED APPLICATIONS

The present disclosure is the national phase under 35 U.S.C 371 of PCT/CN2019/117369 filed on Nov. 12, 2019, which claims priority to Chinese Patent Application No. 2019101443809, filed with the Chinese Patent Office on Feb. 26, 2019, entitled "Vehicle Lamp Module and Vehicle Using Same", both of which are incorporated herein by reference in their entireties.

TECHNICAL FIELD

The present disclosure relates to the technical field of automobile parts, and in particular to a vehicle lamp module and a vehicle using the same.

BACKGROUND ART

In the technical field of vehicle lamps, a vehicle lamp module generally refers to a device having a lens or a component with an equivalent structure as the final light outputting element and configured as a low beam or high beam lighting unit of a vehicle headlight. In recent years, as the automotive industry has been gradually developed well and stably, vehicle lamp modules have found increasing applications. More and more requirements are placed on the overall performance of vehicle lamp modules in the automotive industry. For example, high requirements are imposed on the uniformity of a low-beam or high-beam light pattern from a vehicle headlight, the visibility of the low beam, the heat dissipation performance, the brightness of the high beam, and the structure, weight and size of a module. Vehicle lamp modules are required to have excellent overall performance. However, there is no corresponding technical solution in the prior art to meet the above-mentioned requirements.

In the prior art, a vehicle lamp module with integrated low and high beam LED light sources is disclosed in a patent application, and a vehicle lamp module using LED light sources is also disclosed in a patent application. The technical problems existing in the prior art can be somewhat ameliorated by the technical solutions disclosed in these patents, but further optimization is still required.

SUMMARY

An object of the present disclosure includes, for example, providing a vehicle lamp module and a vehicle using the same, so as to solve the technical problems of the prior art vehicle headlights which cannot achieve excellent overall performance including the uniformity of a low-beam or high-beam light pattern, the visibility of the low beam, and the brightness of the high beam.

Embodiments of the present disclosure are implemented as follows.

An embodiment of the present disclosure provides a vehicle lamp module, comprising: a low beam reflector and a high beam condenser, the low beam reflector serving as a primary optical element for a low beam, the high beam condenser serving as a primary optical element for a high beam; and further comprising: a low beam circuit board provided with a low beam light source, a high beam circuit board provided with a high beam light source, and a lens.

The low beam circuit board is arranged at a position below the low beam reflector, and an optical center of the low beam light source on the low beam circuit board is located at a first focus position of the low beam reflector. The high beam condenser is arranged at a position in front of the low beam circuit board, a light exiting surface of the high beam condenser is located at a second focus of the low beam reflector, there is a distance less than or equal to 2 mm between the position of an upper side boundary of the light exiting surface of the high beam condenser and the second focus of the low beam reflector in a front-to-rear direction, and the upper side boundary of the light exiting surface of the high beam condenser is shaped like a low beam cut-off line so as to be configured to intercept low-beam light to create a low-beam light pattern. The lens is arranged at a position in front of the high beam condenser, and light emitted from the low beam light source is reflected by the low beam reflector and then is directed to the lens over the light exiting surface of the high beam condenser and refracted by the lens to form a low-beam light pattern. Light emitted from the high beam light source is refracted (and reflected) by the high beam condenser and then exits from the light exiting surface of the high beam condenser and is directed to the lens and refracted by the lens to form a high-beam light pattern.

Optionally, there is zero distance between the position of the upper side boundary of the light exiting surface of the high beam condenser and the second focus of the low beam reflector in an optical axis direction of the lens.

Optionally, the low beam reflector includes an inner concave surface and an outer convex surface opposite to each other, and the inner concave surface is provided with a first reflecting surface region of the low beam reflector and a second reflecting surface region of the low beam reflector. A first focus of the first reflecting surface region of the low beam reflector is set at the optical center of the low beam light source, a second focus of the first reflecting surface region of the low beam reflector is set on the light exiting surface of the high beam condenser, and there is a distance less than or equal to 2 mm between the position of the upper side boundary of the light exiting surface of the high beam condenser and the second focus of the first reflecting surface region of the low beam reflector in the front-to-rear direction.

The light emitted from the low beam light source is reflected by the first reflecting surface region of the low beam reflector and then is directed to the lens over the light exiting surface of the high beam condenser and refracted by the lens to form a first low-beam light pattern region.

The light emitted from the low beam light source is reflected by the second reflecting surface region of the low beam reflector and then is directed to the lens over the light exiting surface of the high beam condenser and refracted by the lens to form a second low-beam light pattern region.

Optionally, the first reflecting surface region of the low beam reflector extends to one edge of the low beam reflector at a side away from the second reflecting surface region of the low beam reflector, and the second reflecting surface region of the low beam reflector extends to the other opposite edge of the low beam reflector at a side away from the first reflecting surface region of the low beam reflector.

Optionally, the first reflecting surface region of the low beam reflector is recessed in a direction toward the outer convex surface from the inner concave surface relative to the second reflecting surface region of the low beam reflector.

Optionally, the first reflecting surface region of the low beam reflector is an elliptical surface, and the first reflecting surface region of the low beam reflector occupies 10% or less of the total area of the low beam reflector.

Optionally, both the surfaces of the first reflecting surface region of the low beam reflector and the second reflecting surface region of the low beam reflector are subjected to aluminizing treatment and aluminized to have a reflectivity greater than or equal to 0.8.

Optionally, the first reflecting surface region of the low beam reflector is polished. The second reflecting surface region of the low beam reflector is not polished.

Optionally, the low beam light source is provided with a light exiting surface, and an angle $\alpha$ less than or equal to 30° is formed between the light exiting surface and a horizontal plane.

Optionally, the low beam light source includes an LED.

Optionally, an optical surface of the high beam condenser includes a light condensing cup structure of the high beam condenser, a totally reflecting surface of the high beam condenser, an upper surface of the high beam condenser, and a light exiting surface of the high beam condenser. The totally reflecting surface of the high beam condenser, the upper surface of the high beam condenser, and the light exiting surface of the high beam condenser are connected in this order. The light condensing cup structure of the high beam condenser is located on a lower side of the totally reflecting surface of the high beam condenser. The totally reflecting surface of the high beam condenser is inclined at an angle relative to the horizontal plane, where 30°≤the inclination angle≤60°. The light exiting surface of the high beam condenser is an arcuate surface, and the light exiting surface of the high beam condenser is located in a circle having a diameter ranging from 30 mm to 200 mm (both inclusive). The light condensing cup structure of the high beam condenser includes a reflecting surface of the light condensing cup structure of the high beam condenser, an inner refracting surface of the light condensing cup structure of the high beam condenser, and an inner central surface of the light condensing cup structure of the high beam condenser.

Optionally, a groove is provided in a bottom of the light condensing cup structure of the high beam condenser, the reflecting surface of the light condensing cup structure of the high beam condenser is provided on an outer peripheral wall of the light condensing cup structure of the high beam condenser, the inner refracting surface of the light condensing cup structure of the high beam condenser is provided on a peripheral wall of the groove, and the inner central surface of the light condensing cup structure of the high beam condenser is provided on a bottom wall of the groove.

Optionally, the high beam light source includes an LED, and the number of the high beam light sources is greater than or equal to 2. The number of the light condensing cup structures of the high beam condenser is equal to the number of the high beam light sources, and the light condensing cup structures of the high beam condenser is in one-to-one correspondence to the high beam light sources and are arranged above the corresponding high beam light sources.

Optionally, a reflection enhancing film is provided on the totally reflecting surface of the high beam condenser and/or the upper surface of the high beam condenser.

Optionally, an antireflection film is provided on the light exiting surface of the high beam condenser.

Optionally, the upper surface of the high beam condenser is subjected to aluminizing treatment and is aluminized to have a reflectivity greater than or equal to 0.8.

Optionally, the vehicle lamp module further includes a heat sink, a lens support, and a module support. The lens support is configured such that the lens is mounted thereto, the module support is configured to connect the heat sink and the lens support, and the module support is configured to be connected to a lamp body of the vehicle lamp.

Optionally, an uneven curved surface(s) is provided on one or both sides of a cooling fin(s) of the heat sink.

Optionally, the heat sink is provided with a first mounting surface and a second mounting surface, and an angle not more than 30° is formed between the first mounting surface and the second mounting surface. The low beam circuit board is mounted on the first mounting surface. The high beam circuit board is mounted on the second mounting surface.

An embodiment of the present disclosure further provides a vehicle, comprising any of the vehicle lamp modules as described above.

Compared with the prior art, the embodiments of the present disclosure include, for example, the following advantageous effects.

A vehicle lamp module according to the present disclosure includes a low beam reflector, a high beam condenser, a lens, a low beam circuit board provided with a low beam light source, and a high beam circuit board provided with a high beam light source, wherein the low beam reflector serves as a primary optical element for a low beam, and the high beam condenser serves as a primary optical element for a high beam. The low beam circuit board is arranged at a position below the low beam reflector, and an optical center of the low beam light source on the low beam circuit board is located at a first focus of the low beam reflector. The high beam condenser is arranged at a position in front of the low beam circuit board, a light exiting surface of the high beam condenser is located at a second focus of the low beam reflector, there is a distance less than or equal to 2 mm between the position of an upper side boundary of the light exiting surface of the high beam condenser and the second focus of the low beam reflector in a front-to-rear direction, and the upper side boundary of the light exiting surface of the high beam condenser is shaped like a low beam cut-off line so as to be configured to intercept low-beam light to form a low-beam light pattern. The lens is arranged at a position in front of the high beam condenser, and light emitted from the low beam light source is reflected by the low beam reflector and then is directed to the lens over the light exiting surface of the high beam condenser and refracted by the lens to form a low-beam light pattern. Light emitted from the high beam light source is refracted and reflected by the high beam condenser and then exits from the light exiting surface of the high beam condenser and is directed to the lens and refracted by the lens to form a high-beam light pattern. It can be seen from this analysis that the vehicle lamp module according to the present disclosure can exhibit a uniform low beam, good high-beam lighting performance, and good high beam/low beam switching performance, because a reflector is provided as a primary optical element with a low-beam function, and a condenser is provided as a primary optical element for a high beam. Moreover, the vehicle lamp module consists of a small number of components, has a simple structure, and involves low cost. Due to the structural design of the low beam reflector and the high beam condenser, a small spatial size is occupied by the optical elements of the module as a whole. In summary, the vehicle lamp module according to the present disclosure can exhibit a uniform light pattern and excellent visibility for low beam, due to the proper arrangement of the optical elements and the parametric design of each optical element, and the vehicle lamp module has a relatively simple structure, a lighter weight, a smaller size and lower cost and has good overall performance.

BRIEF DESCRIPTION OF THE DRAWINGS

In order to more clearly illustrate technical solutions of specific embodiments of the present disclosure or of the prior art, drawings required for use in the description of the specific embodiments or the prior art will be described briefly below. It is obvious that the drawings in the following description are illustrative of some embodiments of the present disclosure. It will be understood by those of ordinary skill in the art that other drawings can also be obtained from these drawings without any inventive effort.

Figure 1:
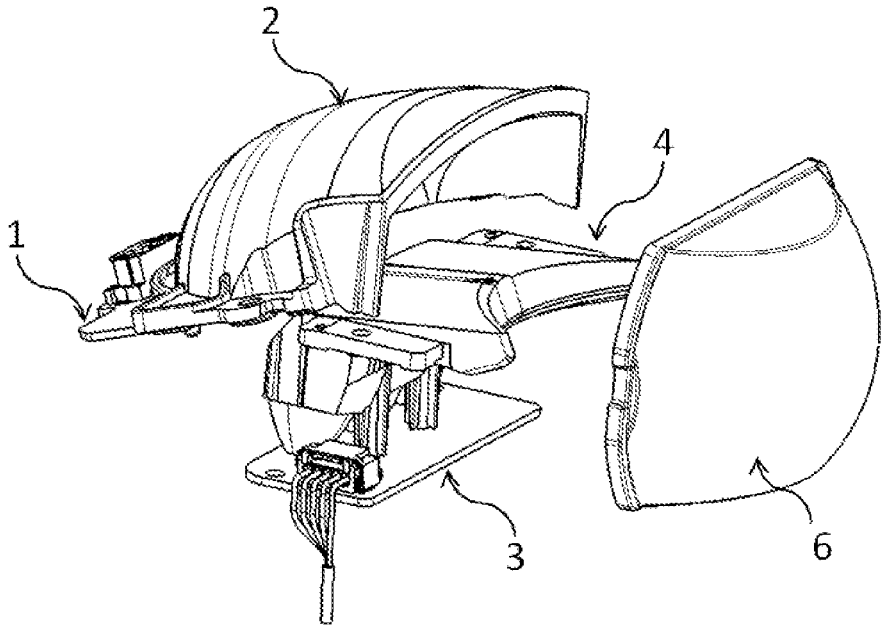
FIG. 1 is a schematic perspective structural view of a vehicle lamp module according to an embodiment of the present disclosure.

In the figures: 1. low beam circuit board, 2. low beam reflector, 21. inner concave surface, 22. outer convex surface, 3. high beam circuit board, 4. high beam condenser, 5. heat sink, 51. cooling fin, 511. curved surface, 52. first mounting surface, 53. second mounting surface, 54. connecting surface, 6. lens, 7. lens support, 8. module support, 1*a*. low beam light source, 10. first focus, 11. second focus, 12. light exiting surface, 2*a*. first reflecting surface region of the low beam reflector, 2*b*. second reflecting surface region of the low beam reflector, 3*a*. high beam light source, 4*a*. light condensing cup structure of the high beam condenser, 41. groove, 4*b*. totally reflecting surface of the high beam condenser, 4*c*. upper surface of the high beam condenser, 4*d*. light exiting surface of the high beam condenser, 401. upper side boundary, 4*a*-1. reflecting surface of the light condensing cup structure of the high beam condenser, 4*a*-2. inner refracting surface of the light condensing cup structure of the high beam condenser, 4*a*-3. inner central surface of the light condensing cup structure of the high beam condenser, R1. emitted low-beam light reflected by the first reflecting surface region of the low beam reflector, R2. first emitted low-beam light reflected by the second reflecting surface region of the low beam reflector, R3. second emitted low-beam light reflected by the second reflecting surface region of the low beam reflector, R4. emitted high-beam light, Lo1. first low-beam light pattern region, Lo2. second low-beam light pattern region, Hi. high-beam light pattern.

DETAILED DESCRIPTION OF THE EMBODIMENTS

The technical solutions of the present disclosure will be described below clearly and completely with reference to the accompanying drawings in order to further clarify the objects, technical solutions, and advantages of the embodiments of the present disclosure. It is apparent that the embodiments to be described are some, but not all of the embodiments of the present disclosure. Generally, the components of the embodiments of the present disclosure, as described and illustrated in the figures herein, may be arranged and designed in a wide variety of different configurations.

Thus, the following detailed description of the embodiments of the present disclosure, as represented in the figures, is not intended to limit the scope of the present disclosure as claimed, but is merely representative of selected embodiments of the present disclosure. All the other embodiments obtained by those of ordinary skill in the art in light of the embodiments of the present disclosure without inventive efforts will fall within the scope of the present disclosure as claimed.

It should be noted that similar reference numerals and letters refer to similar items in the following figures, and thus once an item is defined in one figure, it may not be further defined or explained in the following figures.

In the description of the present disclosure, it should be noted that the terms such as "center", "up", "down", "left", "right", "vertical", "horizontal", "inside", and "outside" indicate the orientation or positional relationships shown based on the figures, and these terms are intended only to facilitate the description of the present disclosure and simplify the description, but not intended to indicate or imply that the referred systems or elements must be in a particular orientation or constructed or operated in the particular orientation, and therefore should not be construed as limiting the present disclosure. In addition, the terms "first", "second", and "third" are used for descriptive purposes only, and should not be understood as an indication or implication of relative importance.

In addition, the term "horizontal", "vertical", "overhanging", or the like, if present, means that a component may be slightly inclined, rather than being required to be absolutely horizontal or overhanging. For example, by the term "horizontal", it is simply meant that its direction is more horizontal than the term "vertical", and it is not meant that the structure must be completely horizontal, but it is meant that the structure may be slightly inclined.

In the description of the present disclosure, it should be noted that the terms "mount", "couple", and "connect" should be understood broadly unless otherwise expressly specified or defined. For example, connection may be fixed connection or detachable connection or integral connection, may be mechanical connection or electric connection, or may be direct coupling or indirect coupling via an intermediate medium or internal communication between two elements. The specific meanings of the above-mentioned terms in the present disclosure can be understood by those of ordinary skill in the art according to specific situations.

It should be noted that features in the embodiments of the present disclosure can be combined with each other without conflict.

As shown in FIGS. 1 to 11, the present disclosure provides a vehicle lamp module, comprising: a low beam reflector 2, a high beam condenser 4, a lens 6, a low beam circuit board 1 provided with a low beam light source 1*a*, and a high beam circuit board 3 provided with a high beam light source 3*a*. The low beam reflector 2 serves as a primary optical element for a low beam, and the high beam condenser 4 serves as a primary optical element for a high beam. When viewed as shown, for example, in FIG. 1, the low beam circuit board 1 is arranged at a position below the low beam reflector 2, and the optical center of the low beam light source 1*a* on the low beam circuit board 1 is located at the first focus 10 of the low beam reflector 2. The high beam condenser 4 is arranged at a position in front of the low beam circuit board 1, and a light exiting surface 4*d* of the high beam condenser is located at the second focus 11 of the low beam reflector 2. There is a distance less than or equal to 2 mm between the position of an upper side boundary 401 of the light exiting surface 4*d* of the high beam condenser and the second focus 11 of the low beam reflector 2 in a front-to-rear direction. Optionally, there is a distance of 0 mm between the position of the upper side boundary 401 of the light exiting surface 4*d* of the high beam condenser and the second focus 11 of the low beam reflector 2 in the front-to-rear direction. In other words, their positions coincide with each other. Such structural arrangement allows for increased optical efficiency. The upper side boundary 401 of the light exiting surface 4*d* of the high beam condenser is shaped like a low beam cut-off line so as to be configured to intercept low-beam light to create a low-beam light pattern. The lens 6 is arranged at a position in front of the high beam condenser 4 and configured to receive light travelling from the light exiting surface 4*d* of the high beam condenser 4. Light emitted from the low beam light source 1*a* is reflected by the low beam reflector 2 and then is directed to the lens 6 over the light exiting surface 4*d* of the high beam condenser and refracted by the lens 6 to form a low-beam light pattern. Light emitted from the high beam light source 3*a* is refracted and reflected by the high beam condenser 4 and then exits from the light exiting surface 4*d* of the high beam condenser and is directed to the lens 6 and refracted by the lens 6 to form a high-beam light pattern Hi.

Compared with the prior art, the vehicle lamp module of the present disclosure has at least the following advantages:

The vehicle lamp module according to the present disclosure, as shown in FIGS. 1 to 11, includes a low beam reflector 2, a high beam condenser 4, a lens 6, a low beam circuit board 1 provided with a low beam light source 1*a*, and a high beam circuit board 3 provided with a high beam light source 3*a*. The low beam reflector 2 serves as a primary optical element for a low beam, and the high beam condenser 4 serves as a primary optical element for a high beam. When viewed as shown, for example, in FIG. 1 or FIG. 2, the low beam circuit board 1 is arranged at a position below the low beam reflector 2, and the optical center of the low beam light source 1*a* is located at the first focus 10 of the low beam reflector 2. The high beam condenser 4 is arranged at a position in front of the low beam circuit board 1, and a light exiting surface 4*d* of the high beam condenser is located at the second focus 11 of the low beam reflector 2. There is a distance less than or equal to 2 mm between the position of an upper side boundary 401 of the light exiting surface 4*d* of the high beam condenser and the second focus 11 of the low beam reflector 2 in a front-to-rear direction. Optionally, there is a distance of 0 mm between the position of the upper side boundary 401 of the light exiting surface 4*d* of the high beam condenser and the second focus 11 of the low beam reflector 2 in the front-to-rear direction. In other words, the second focus 11 of the low beam reflector 2 is located on the upper side boundary 401 of the light exiting surface 4*d* of the high beam condenser. Such structural arrangement allows for increased optical efficiency. The upper side boundary 401 of the light exiting surface 4*d* of the high beam condenser is shaped like a low beam cut-off line so as to be configured to intercept low-beam light to create a low-beam light pattern. The lens 6 is arranged at a position in front of the high beam condenser 4 and configured to receive light travelling from the light exiting surface 4*d* of the high beam condenser 4. Light emitted from the low beam light source 1*a* is reflected by the low beam reflector 2 and then is directed to the lens 6 over the light exiting surface 4*d* of the high beam condenser and refracted by the lens 6 to form a low-beam light pattern. Light emitted from the high beam light source 3*a* is refracted and reflected by the high beam condenser 4 and then exits from the light exiting surface 4*d* of the high beam condenser and is directed to the lens 6 and refracted by the lens 6 to form a high-beam light pattern Hi. It can be seen from this analysis that the vehicle lamp module according to the present disclosure can exhibit a uniform low beam, good high-beam lighting performance, and good high beam/low beam switching performance, because the low beam reflector 2 is provided as a primary optical element with a low-beam function, and the high beam condenser 4 is provided as a primary optical element with a high-beam function. Moreover, the vehicle lamp module consists of a small number of components, has a simple structure, and involves low cost. Due to the structural design of the low beam reflector 2 and the high beam condenser 4, a small spatial size is occupied by the optical elements of the vehicle lamp module as a whole. In summary, the vehicle lamp module according to the present disclosure can exhibit a uniform light pattern and excellent low-beam visibility due to the proper arrangement of the optical elements and the parametric design of each optical element, and the vehicle lamp module has a relatively simple structure, a lighter weight, a smaller size and lower cost and has good overall performance.

It should be additionally noted here that the front-to-rear direction in the present disclosure is a direction of emission of light from the vehicle lamp module, i.e., the optical axis direction of the lens 6; and the top-to-bottom direction is the same as the direction of gravity. In addition, a reflector is selected and used as the primary optical element for a low beam because the reflector provides a more uniform light pattern than a condenser, and the reflector designed with a proper optical surface can also provide better low-beam visibility. The primary optical element for a high beam is a condenser, namely, the high beam condenser 4 in the components constituting the vehicle lamp module assembly. The condenser is selected and used as the primary optical element for a high beam because the condenser can provide a high beam with better optical performance than the reflector.

In the present disclosure, the upper side boundary 401 of the light exiting surface 4*d* of the high beam condenser is shaped like a low beam cut-off line and configured to intercept low-beam light to create a low-beam light pattern. In the prior art, a low beam cut-off line is generally formed by intercepting light with a structure having a cut-off line shape. In the present disclosure, the shape of the low beam cut-off line is made on the high beam condenser 4, which is advantageous in that the optical elements are assembled with high accuracy and the vehicle lamp module is obtained with a simple structure and low cost.

Figure 4:
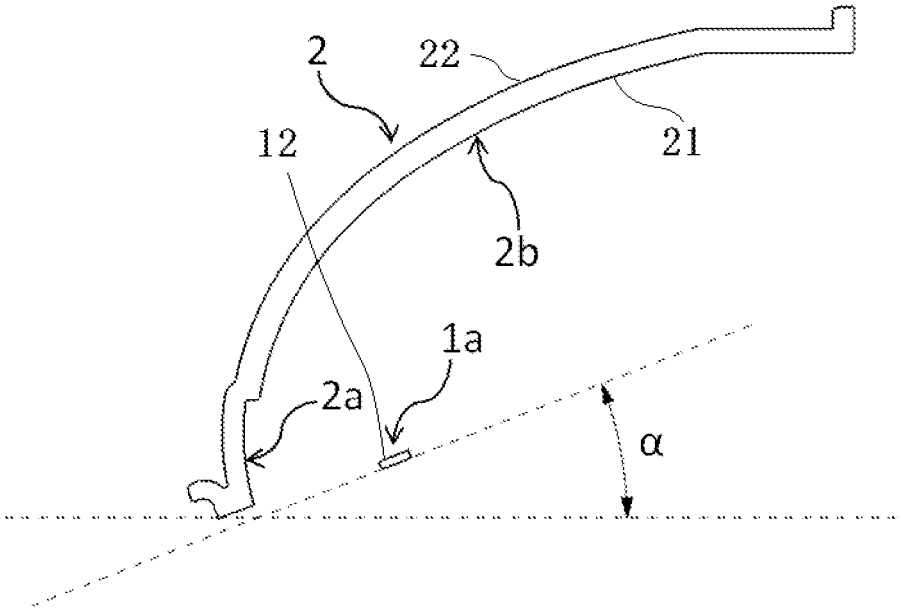
FIG. 4 is a schematic sectional structural view of a low beam reflector according to an embodiment of the present disclosure.

As shown in FIG. 4, optionally, the low beam reflector 2 is substantially in the shape of an arcuate plate and has a regular structure which can be easily machined and manufactured. The low beam reflector 2 has an inner concave surface 21 and an outer convex surface 22 opposite to each other, and the inner concave surface 21 faces the lens 6. The inner concave surface 21 of the low beam reflector 2 is provided with a first reflecting surface region 2*a* of the low beam reflector and a second reflecting surface region 2*b* of the low beam reflector. When viewed as shown, for example, in FIG. 4, the first reflecting surface region 2*a* of the low beam reflector is provided at a position on the lower side of the low beam reflector 2. In other words, the inner concave surface 21 includes a first reflecting surface region 2*a* of the low beam reflector and a second reflecting surface region 2*b* of the low beam reflector connected to each other. The first reflecting surface region 2*a* of the low beam reflector extends to one edge of the low beam reflector 2 at a side away from the second reflecting surface region 2*b* of the low beam reflector, and the second reflecting surface region 2*b* of the low beam reflector extends to the other opposite edge of the low beam reflector 2 at a side away from the first reflecting surface region 2*a* of the low beam reflector. Optionally, the first reflecting surface region 2*a* of the low beam reflector is recessed in a direction toward the outer convex surface 22 from the inner concave surface 21 relative to the second reflecting surface region 2*b* of the low beam reflector. In other words, the inner concave surface 21 of the low beam reflector 2 is formed as a stepped structure, the first reflecting surface region 2*a* of the low beam reflector is located on a lower side of the stepped structure, and the second reflecting surface region 2*b* of the low beam reflector is located on a higher side of the stepped structure. In this way, the first reflecting surface region 2*a* of the low beam reflector and the second reflecting surface region 2*b* of the low beam reflector are blocked from each other and are less likely to interfere with each other, which facilitates the travelling of light. Optionally, both the first reflecting surface region 2*a* of the low beam reflector and the second reflecting surface region 2*b* of the low beam reflector may be elliptical surfaces, and the area of the first reflecting surface region 2*a* of the low beam reflector occupies 10% or less of the total area of the low beam reflector 2. Optionally, the area of the first reflecting surface region 2*a* of the low beam reflector occupies 7% of the total area of the low beam reflector 2, where the total area refers to the surface area of the inner concave surface 21.

Figure 8:
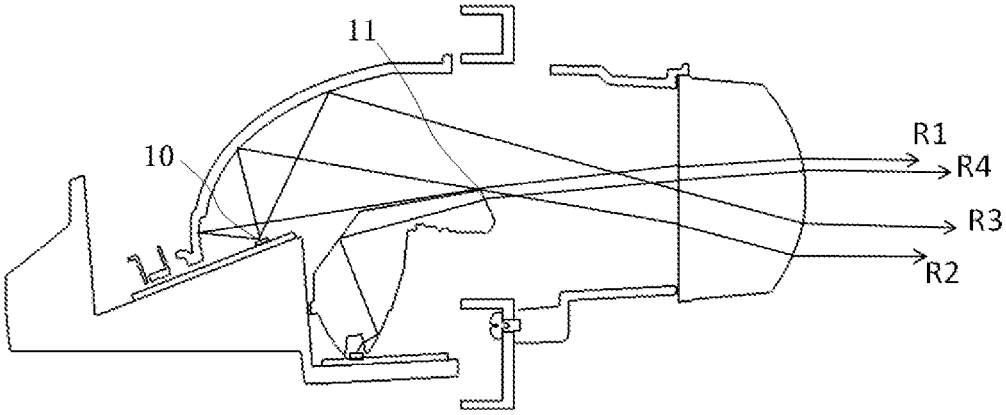
FIG. 8 is a schematic view showing directions of travel of light from a vehicle lamp module according to an embodiment of the present disclosure.
Figure 9:
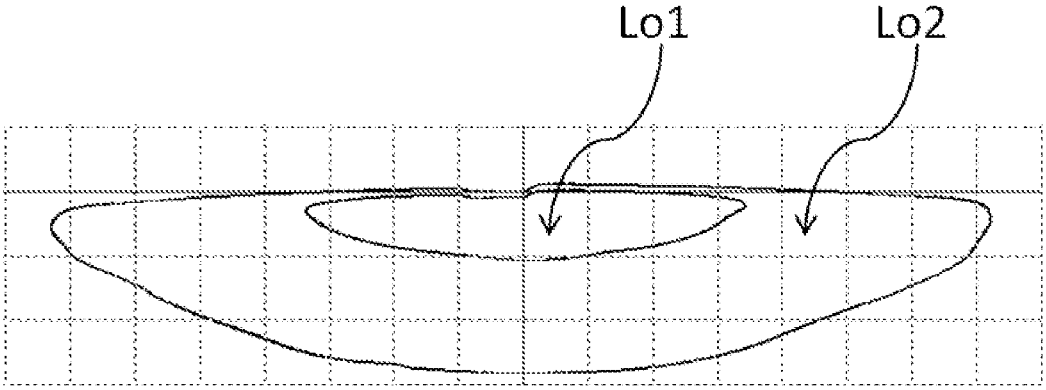
FIG. 9 is a schematic view showing a low-beam light pattern from a vehicle lamp module according to an embodiment of the present disclosure.
Figure 10:
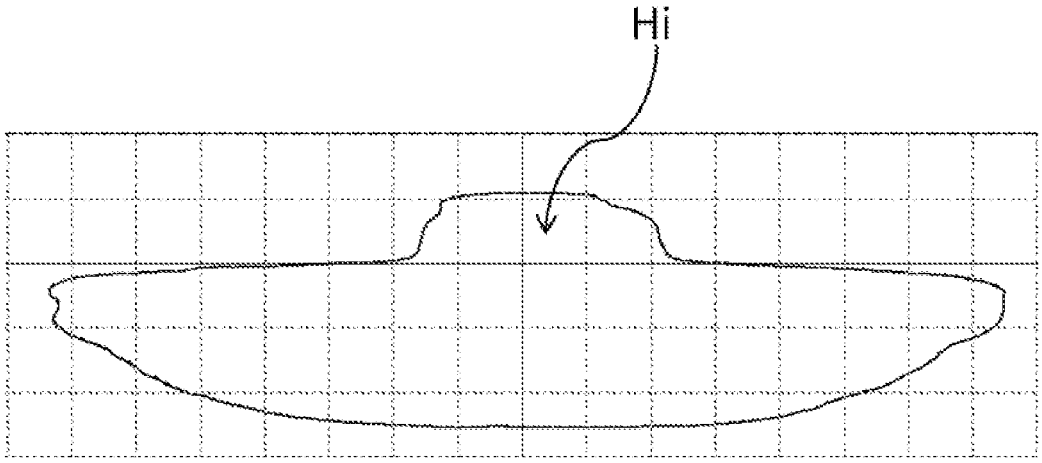
FIG. 10 is a schematic view showing a high-beam light pattern from a vehicle lamp module according to an embodiment of the present disclosure.

Optionally, both the surfaces of the first reflecting surface region 2*a* of the low beam reflector and the second reflecting surface region 2*b* of the low beam reflector are subjected to aluminizing treatment and are aluminized to have a reflectivity greater than or equal to 0.8. Referring to FIG. 8, the first focus 10 of the first reflecting surface region 2*a* of the low beam reflector is set at the optical center of the low beam light source 1*a*. The second focus 11 of the first reflecting surface region 2*a* of the low beam reflector is set on the light exiting surface 4*d* of the high beam condenser, and there is a distance less than or equal to 2 mm between the position of the upper side boundary 401 of the light exiting surface 4*d* of the high beam condenser and the second focus 11 of the first reflecting surface region 2*a* of the low beam reflector in the front-to-rear direction. Optionally, there is a distance of 0 mm between the position of the upper side boundary 401 of the light exiting surface 4*d* of the high beam condenser and the second focus 11 of the low beam reflector 2 in the front-to-rear direction. The second focus 11 of the first reflecting surface region 2*a* of the low beam reflector is located on the upper side boundary 401 of the light exiting surface 4*d* of the high beam condenser. This arrangement allows an increase in optical efficiency and also an increase in the light pattern brightness of the low-beam light pattern at 75R and in its vicinity. Referring to FIG. 9, light emitted from the low beam light source 1*a* is reflected by the first reflecting surface region 2*a* of the low beam reflector and then is directed to the lens 6 over the light exiting surface 4*d* of the high beam condenser and refracted by the lens 6 to form a first low-beam light pattern region Lo1. The first low-beam light pattern region Lo1 consists of the regulated test point 75R and its vicinal region below the low beam cut-off line, which can increase the low-beam visibility. The light emitted from the low beam light source 1*a* is reflected by the second reflecting surface region 2*b* of the low beam reflector and then is directed to the lens 6 over the light exiting surface 4*d* of the high beam condenser and refracted by the lens 6 to form a second low-beam light pattern region Lo2. The second low-beam light pattern region Lo2 is a widened or expanded region below the low beam cut-off line. The second low-beam light pattern region Lo2 and the first low-beam light pattern region Lo1 partially overlap each other, which can increase a low-beam irradiation range. In the present disclosure, optionally, the first low-beam light pattern region Lo1 wholly falls within the second low-beam light pattern region Lo2.

It should be additionally noted here that the first reflecting surface region 2*a* of the low beam reflector is provided at a position on the lower side of the low beam reflector 2. The first reflecting surface region 2*a* of the low beam reflector may be an elliptical surface and occupy 10% or less of the total area of the low beam reflector 2. Optionally, the area of the first reflecting surface region 2*a* of the low beam reflector occupies 7% of the total area of the low beam reflector 2. The reflecting surface of the low beam reflector 2 is designed as above because the reflecting surface region on the lower side of the low beam reflector 2 close to the low beam light source 1*a* mainly creates a low-beam light pattern at 75R and in its vicinity, while the other reflecting surface regions mainly create a widened low-beam light pattern. As the first reflecting surface region 2*a* of the low beam reflector is provided close to the low beam light source 1*a* and has a defined area, the brightness of the low-beam light pattern at 75R and in its vicinity can be increased, whereby the low-beam visibility can be increased.

Optionally, the low beam light source 1*a* includes an LED, and the bottom surface of the low beam light source 1*a* forms an angle $\alpha$ relative to the front-to-rear direction. In other words, when viewed, for example, in FIG. 4, the low beam light source 1*a* includes a bottom surface and a light exiting surface 12 parallel to each other, and there is an angle $\alpha$ between the light exiting surface 12 and the horizontal plane. In the present disclosure, $\alpha \leq 30°$, and optionally, $\alpha$ is 21°. The angle between the low beam reflector 2 and the horizontal plane is equal to the angle $\alpha$. As the low beam light source 1*a* and the low beam reflector 2 are inclined upward at a certain angle, more light can be directed into the lens 6 to increase the optical efficiency of the low beam, and chromatic dispersion at the cut-off line of the low beam can also be ameliorated.

Optionally, the first reflecting surface region 2*a* of the low beam reflector is polished; and the second reflecting surface region 2*b* of the low beam reflector is not polished. Such design is made because the first reflecting surface region 2*a* of the low beam reflector is provided to increase the low-beam visibility and the visibility can be further increased by a polishing treatment, while the second reflecting surface region 2*b* of the low beam reflector is provided to widen a low-beam light pattern, and the uniformity of the widened light pattern can be optimized without a polishing treatment so that a driver can get a good visual experience.

As shown in FIGS. 5 to 8, optionally, an optical surface of the high beam condenser 4 includes a light condensing cup structure 4*a* of the high beam condenser, a totally reflecting surface 4*b* of the high beam condenser, an upper surface 4*c* of the high beam condenser, and a light exiting surface 4*d* of the high beam condenser. The totally reflecting surface 4*b* of the high beam condenser, the upper surface 4*c* of the high beam condenser, and the light exiting surface 4*d* of the high beam condenser are connected in this order, and the light condensing cup structure 4*a* of the high beam condenser is located under the totally reflecting surface 4*b* of the high beam condenser. The light condensing cup structure 4*a* of the high beam condenser includes a reflecting surface 4*a*-1 of the light condensing cup structure of the high beam condenser, an inner refracting surface 4*a*-2 of the light condensing cup structure of the high beam condenser, and an inner central surface 4*a*-3 of the light condensing cup structure of the high beam condenser. The reflecting surface 4*a*-1 of the light condensing cup structure of the high beam condenser is provided as an outer peripheral wall of the light condensing cup structure 4*a* of the high beam condenser. A groove 41 is provided in the bottom of the light condensing cup structure 4*a* of the high beam condenser. The inner refracting surface 4*a*-2 of the light condensing cup structure of the high beam condenser is provided as a peripheral wall of the groove 41. The inner central surface 4*a*-3 of the light condensing cup structure of the high beam condenser is provided as a bottom wall of the groove 41.

Figure 11:
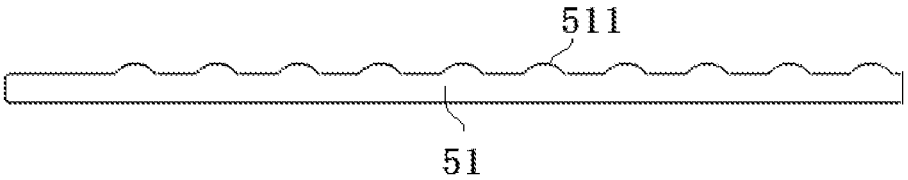
FIG. 11 is a schematic partial structural view of a cooling fin of a heat sink in a vehicle lamp module according to an embodiment of the present disclosure.

The totally reflecting surface 4*b* of the high beam condenser is arranged at a position above the light condensing cup structure 4*a* of the high beam condenser and is inclined relative to the front-to-rear direction. In other words, the totally reflecting surface 4*b* of the high beam condenser is inclined relative to the horizontal plane, optionally, at an inclination angle between 30° and 60° (both inclusive). Optionally, the totally reflecting surface 4*b* of the high beam condenser is inclined at an angle of 45° relative to the horizontal plane. It should be understood that the totally reflecting surface 4*b* of the high beam condenser may be inclined at an angle of 30° or 60° relative to the horizontal plane. Optionally, the totally reflecting surface 4*b* of the high beam condenser may be inclined relative to the horizontal plane at an inclination angle between 30° and 45° (both inclusive) or between 45° and 60° (both inclusive). The upper surface 4*c* of the high beam condenser is arranged in the front-to-rear direction, and the two opposite sides of the upper surface 4*c* of the high beam condenser are connected to the totally reflecting surface 4*b* of the high beam condenser and the light exiting surface 4*d* of the high beam condenser, respectively. The light exiting surface 4*d* of the high beam condenser may be an arcuate surface, and the light exiting surface 4*d* of the high beam condenser is located in a circle having a diameter ranging from 30 mm to 200 mm (both inclusive). Optionally, the light exiting surface 4*d* of the high beam condenser is located in a circle having a diameter of 30 mm, 100 mm or 200 mm, or the light exiting surface 4*d* of the high beam condenser is located in a circle having a diameter between 30 mm and 100 mm (both inclusive), or the light exiting surface 4*d* of the high beam condenser is located in a circle having a diameter between 100 mm and 200 mm (both inclusive). As shown in FIG. 11, the figure shows a schematic view of a high-beam light pattern. Light emitted from the high beam light source 3*a* is refracted and reflected by the light condensing cup structure 4*a* of the high beam condenser and then travels upward in the high beam condenser 4, and then is totally reflected by the totally reflecting surface 4*b* of the high beam condenser and then continues to travel in the high beam condenser 4 under the upper surface 4*c* of the high beam condenser, and is refracted from the light exiting surface 4*d* of the high beam condenser to the lens 6 and refracted by the lens 6 to form a high-beam light pattern Hi.

In the present disclosure, the high beam condenser 4 is provided with a totally reflecting surface 4*b* of the high beam condenser, so that the high beam condenser 4 has a substantially "L"-shaped structure. In this way, the size and space of the module in the front-to-rear direction can be reduced, and the low beam light source 1*a* and the high beam light source 3*a* are fully separated from each other. The heat dissipation performance is greatly improved by the long distance between the heat sources.

The high beam condenser 4 is in the shape of an "L" shape, so that heat sources for high beam and low beam are spaced apart by a long distance, which greatly improves the heat dissipation performance of the vehicle lamp module.

Figure 5:
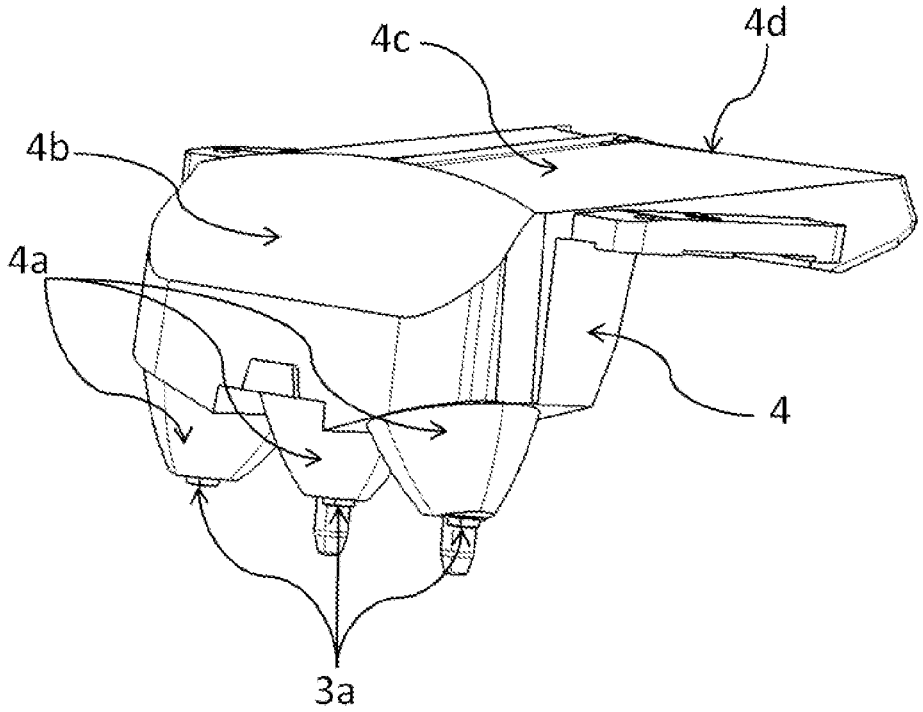
FIG. 5 is a schematic perspective structural view of a high beam condenser in a vehicle lamp module according to an embodiment of the present disclosure.
Figure 6:
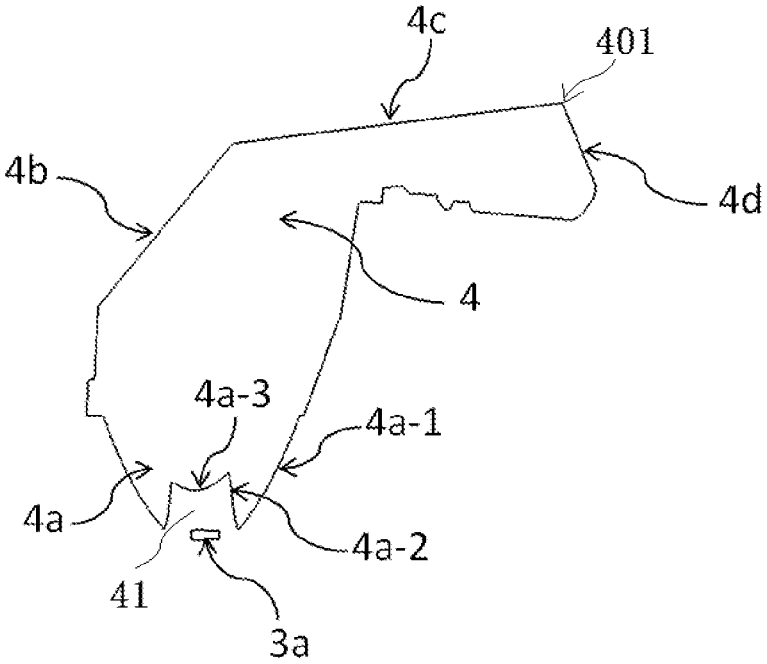
FIG. 6 is a schematic sectional structural view of a high beam condenser in a vehicle lamp module according to an embodiment of the present disclosure.
Figure 7:
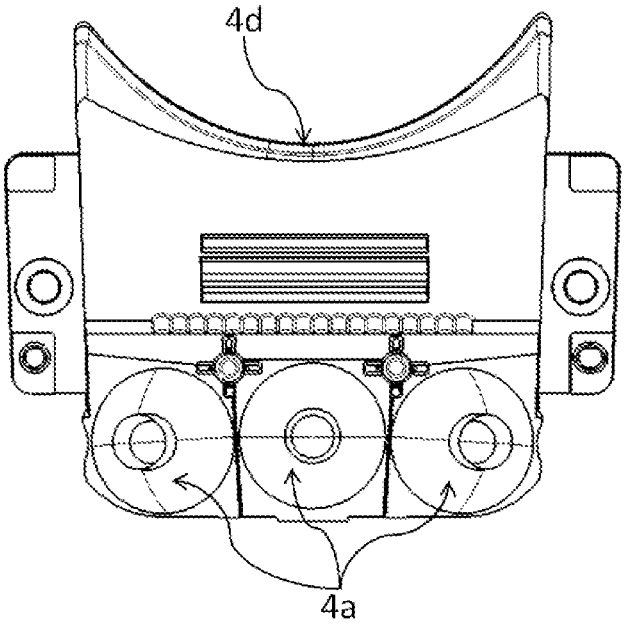
FIG. 7 is a schematic structural bottom view of a high beam condenser in a vehicle lamp module according to an embodiment of the present disclosure.

Optionally, as shown in FIGS. 5 and 7, the high beam light source 3*a* includes an LED, and the number of the high beam light sources 3*a* is greater than or equal to 2. Optionally, there are three high beam light sources 3*a*. The light condensing cup structures 4*a* of the high beam condenser are provided in the same number as the high beam light sources 3*a* and are arranged above the corresponding high beam light sources 3*a*. For example, in the present disclosure, there are three high beam light sources 3*a*, and there are three light condensing cup structures 4*a* in the high beam condenser. The three light condensing cup structures 4*a* of the high beam condenser are arranged in one-to-one correspondence to the three high beam light sources 3*a*, and each of the high beam light sources 3*a* is located at the opening of the groove 41 of the corresponding light condensing cup structure 4*a* of the high beam condenser.

Optionally, a reflection enhancing film is provided on the totally reflecting surface 4*b* of the high beam condenser and/or the upper surface 4*c* of the high beam condenser, thereby effectively increasing the reflectivity of light irradiated onto the surface to further increase the optical efficiency of the vehicle lamp module. An antireflection film is provided on the light exiting surface 4*d* of the high beam condenser, thereby effectively increasing the transmittance of light through the light exiting surface 4*d* of the high beam condenser to further increase the optical efficiency of the vehicle lamp module.

Optionally, the upper surface 4*c* of the high beam condenser is subjected to aluminizing treatment and aluminized to have a reflectivity greater than or equal to 0.8, thereby effectively increasing the reflectivity of the low-beam light irradiated onto the upper surface 4*c* of the high beam condenser to further increase the optical efficiency of the vehicle lamp module.

Figure 2:
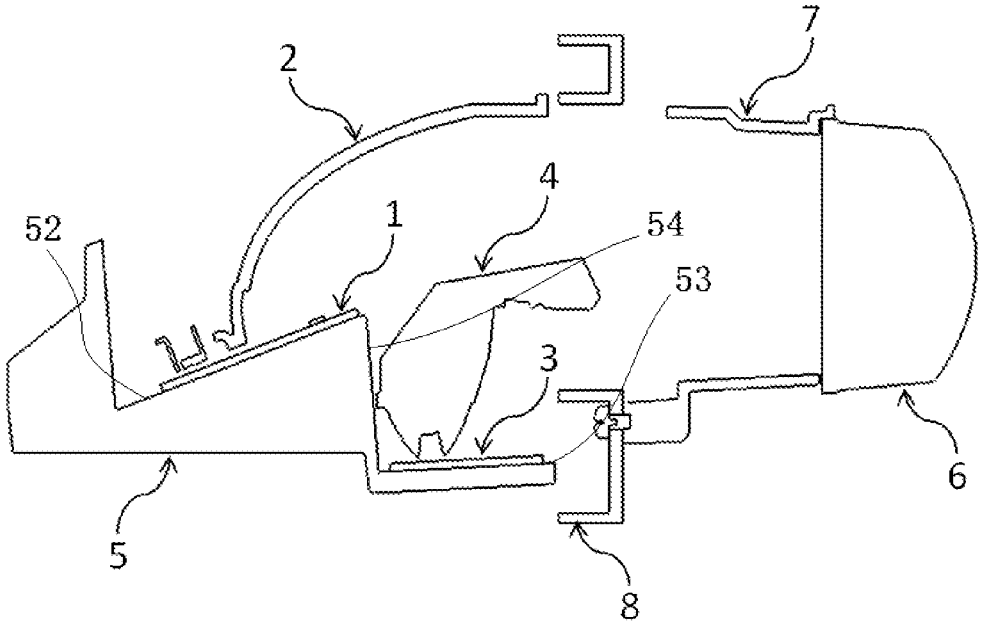
FIG. 2 is a schematic sectional structural view of a vehicle lamp module according to an embodiment of the present disclosure.
Figure 3:
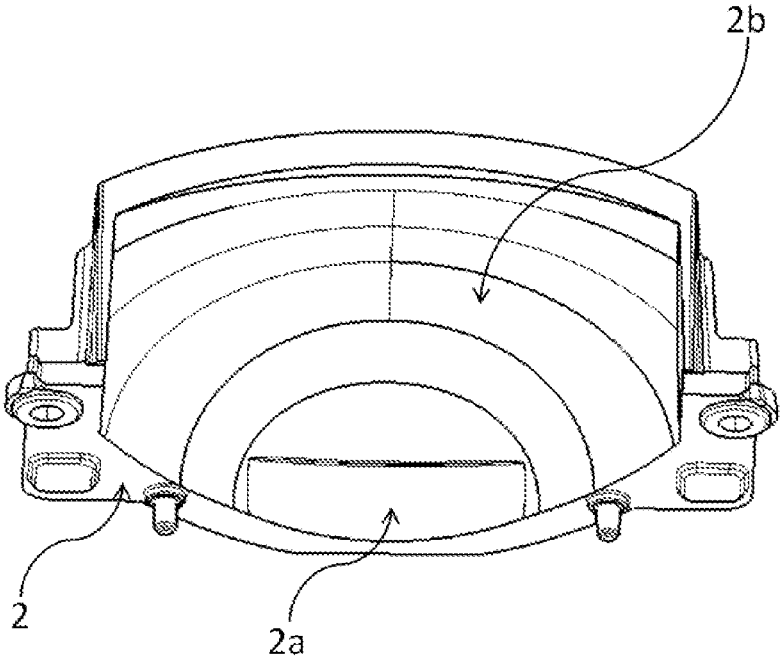
FIG. 3 is a schematic perspective structural view of an optical component in a vehicle lamp module according to an embodiment of the present disclosure.

Referring to FIG. 2, in the present disclosure, the vehicle lamp module according to the present disclosure may further include a heat sink 5, a lens support 7, and a module support 8. An uneven (or concavo-convex) or/and undulating curved surface(s) 511 is provided on one or both sides of a cooling fin(s) 51 of the heat sink 5. The lens support 7 is configured such that the lens 6 is mounted thereto, but another mounting configuration in which the lens 6 is designed on the heat sink 5 or on another component is not excluded. The module support 8 is configured to connect the heat sink 5 and the lens support 7, and the module support 8 may be connected to a lamp body of the vehicle lamp. Due to the structural design of the module support 8, the heat sink 5 and a component assembly thereon can be detached separately from the rear of the lamp body to facilitate replacement of the light sources.

Optionally, the heat sink 5 is provided with a first mounting surface 52 and a second mounting surface 53. The second mounting surface 53 is parallel to the horizontal plane. An angle ranging from 0° to 30° is formed between the first mounting surface 52 and the second mounting surface 53. Optionally, an angle of 30° is formed between the first mounting surface 52 and the second mounting surface 53. Optionally, the first mounting surface 52 and the second mounting surface 53 are connected by a connecting surface 54. The connecting surface 54 is arranged vertically. The first mounting surface 52 and the second mounting surface 53 are not directly connected to each other and have a certain height difference. The low beam circuit board 1 is arranged on the first mounting surface 52, and the high beam circuit board 3 is arranged on the second mounting surface 53, so that there is a height difference between the low beam light source 1*a* on the low beam circuit board 1 and the high beam light source 3*a* on the high beam circuit board 3, and the low beam light source 1*a* and the high beam light source 3*a* are fully separated from each other. The heat dissipation performance of the vehicle lamp module is greatly improved by the long distance between the heat sources. During mounting, the relative positions of the low beam circuit board 1 and the high beam circuit board 3 are determined. When the mounting is completed, the angle between the low beam light source 1*a* and the horizontal plane is determined, and its position is accurate, which allows for easy mounting with increased mounting efficiency.

An uneven or/and undulating curved surface(s) 511 is provided on one or both sides of a cooling fin(s) 51 of the heat sink 5, so that the heat dissipation area of the heat sink 5 can be increased without increasing the size of the heat sink 5, thereby further improving the heat dissipation performance of the heat sink 5.

It should be additionally noted here that, in the vehicle lamp module according to the present disclosure, as shown in FIG. 8, R1 is outgoing low-beam light emitted from the low beam light source 1*a* and reflected by the first reflecting surface region 2*a* of the low beam reflector, R2 is first outgoing low-beam light emitted from the low beam light source 1*a* and reflected by the second reflecting surface region 2*b* of the low beam reflector, R3 is second outgoing low-beam light emitted from the low beam light source 1*a* and reflected by the second reflecting surface region 2*b* of the low beam reflector, and R4 is outgoing high-beam light emitted from the high beam light source 3*a*.

The present disclosure further provides a vehicle comprising the vehicle lamp module as mentioned above.

The vehicle lamp module and the vehicle according to the present disclosure are provided with proper primary optical elements with low-beam and high-beam functions, and the primary optical elements with low-beam and high-beam functions and a related system are designed in an optimized manner, so that the vehicle lamp module has good uniformity, good visibility, good heat dissipation performance, and good high-beam lighting performance. Moreover, the vehicle lamp module has a relatively light weight, small size, and low cost. In other words, the vehicle lamp module has better overall performance.

The above description is merely illustrative of preferred embodiments of the present disclosure and is not intended to limit the present disclosure. Any modifications, equivalent alternatives, improvements and so on made within the spirit and principle of the present disclosure are intended to be encompassed within the scope of protection of the present disclosure.

INDUSTRIAL APPLICABILITY

In summary, the present disclosure provides a vehicle lamp module and a vehicle using the same, which has good overall performance.

What is claimed is:

1. A vehicle lamp module, comprising: a low beam reflector and a high beam condenser, wherein the low beam reflector serves as a primary optical element for a low beam, and the high beam condenser serves as a primary optical element for a high beam;

further comprising: a low beam circuit board provided with a low beam light source, a high beam circuit board provided with a high beam light source and a lens, wherein the low beam circuit board is arranged at a position below the low beam reflector, and an optical center of the low beam light source on the low beam circuit board is located at a first focus position of the low beam reflector;

the high beam condenser is arranged at a position in front of the low beam circuit board, a light exiting surface of the high beam condenser is located at a second focus of the low beam reflector, a distance between a position of an upper side boundary of the light exiting surface of the high beam condenser and the second focus of the low beam reflector is less than or equal to 2 mm in a front-to-rear direction, and the upper side boundary of the light exiting surface of the high beam condenser is shaped like a low beam cut-off line, so as to be configured to intercept low-beam light to form a low-beam light pattern;

the lens is arranged at a position in front of the high beam condenser, and light emitted from the low beam light source is reflected by the low beam reflector and then is directed to the lens over the light exiting surface of the high beam condenser and refracted by the lens, so as to form a low-beam light pattern; and light emitted from the high beam light source is refracted by the high beam condenser and then exits from the light exiting surface of the high beam condenser, and is directed to the lens and refracted by the lens, so as to form a high-beam light pattern.

2. The vehicle lamp module according to claim 1, wherein the position of the upper side boundary of the light exiting surface of the high beam condenser and the second focus of the low beam reflector have therebetween a distance of zero in an optical axis direction of the lens.

3. The vehicle lamp module according to claim 1, wherein the low beam reflector comprises an inner concave surface and an outer convex surface opposite to each other, wherein the inner concave surface is provided with a first reflecting surface region of the low beam reflector and a second reflecting surface region of the low beam reflector; a first focus of the first reflecting surface region of the low beam reflector is set at the optical center of the low beam light source, a second focus of the first reflecting surface region of the low beam reflector is set on the light exiting surface of the high beam condenser, and a distance between the position of the upper side boundary of the light exiting surface of the high beam condenser and the second focus of the first reflecting surface region of the low beam reflector is less than or equal to 2 mm in the front-to-rear direction;

light emitted from the low beam light source is reflected by the first reflecting surface region of the low beam reflector and then is directed to the lens over the light exiting surface of the high beam condenser and refracted by the lens, so as to form a first low-beam light pattern region; and light emitted from the low beam light source is reflected by the second reflecting surface region of the low beam reflector and then is directed to the lens over the light exiting surface of the high beam condenser and refracted by the lens, so as to form a second low-beam light pattern region.

4. The vehicle lamp module according to claim 3, wherein a side of the first reflecting surface region of the low beam reflector away from the second reflecting surface region of the low beam reflector extends to one edge of the low beam reflector, and a side of the second reflecting surface region of the low beam reflector away from the first reflecting surface region of the low beam reflector extends to the other opposite edge of the low beam reflector.

5. The vehicle lamp module according to claim 3, wherein the first reflecting surface region of the low beam reflector is recessed in a direction toward the outer convex surface from the inner concave surface relative to the second reflecting surface region of the low beam reflector.

6. The vehicle lamp module according to claim 3, wherein the first reflecting surface region of the low beam reflector is an elliptical surface, and the first reflecting surface region of the low beam reflector occupies 10% or less of a total area of the low beam reflector.

7. The vehicle lamp module according to claim 3, wherein both surfaces of the first reflecting surface region of the low beam reflector and the second reflecting surface region of the low beam reflector are subjected to aluminizing treatment, with an aluminizing reflectivity greater than or equal to 0.8.

8. The vehicle lamp module according to claim 3, wherein the first reflecting surface region of the low beam reflector is polished; and the second reflecting surface region of the low beam reflector is not polished.

9. The vehicle lamp module according to claim 1, wherein the low beam light source is provided with a light exiting surface, and an angle $\alpha$ less than or equal to 30° is formed between the light exiting surface and a horizontal plane.

10. The vehicle lamp module according to claim 9, wherein the low beam light source comprises an LED.

11. The vehicle lamp module according to claim 1, wherein an optical surface of the high beam condenser comprises a light condensing cup structure of the high beam condenser, a totally reflecting surface of the high beam condenser, an upper surface of the high beam condenser, and a light exiting surface of the high beam condenser, wherein the totally reflecting surface of the high beam condenser, the upper surface of the high beam condenser and the light exiting surface of the high beam condenser are connected in sequence; the light condensing cup structure of the high beam condenser is located on a lower side of the totally reflecting surface of the high beam condenser; the totally reflecting surface of the high beam condenser is inclined at an angle relative to the horizontal plane, wherein 30°≤an inclination angle≤60°; and the light exiting surface of the high beam condenser is an arcuate surface, and the light exiting surface of the high beam condenser is located in a circle having a diameter in a range of 30 mm≤the diameter≤200 mm; and the light condensing cup structure of the high beam condenser comprises a reflecting surface of the light condensing cup structure of the high beam condenser, an inner refracting surface of the light condensing cup structure of the high beam condenser, and an inner central surface of the light condensing cup structure of the high beam condenser.

12. The vehicle lamp module according to claim 11, wherein a groove is provided in a bottom of the light condensing cup structure of the high beam condenser, the reflecting surface of the light condensing cup structure of the high beam condenser is provided on an outer peripheral wall of the light condensing cup structure of the high beam condenser, the inner refracting surface of the light condensing cup structure of the high beam condenser is provided on a peripheral wall of the groove, and the inner central surface of the light condensing cup structure of the high beam condenser is provided on a bottom wall of the groove.

13. The vehicle lamp module according to claim 11, wherein the high beam light source comprises an LED, and high beam light sources are provided in a number greater than or equal to 2; and light condensing cup structures of the high beam condenser are equal in number to the high beam light sources, and the light condensing cup structures of the high beam condenser are in one-to-one correspondence to the high beam light sources and are arranged above corresponding high beam light sources.

14. The vehicle lamp module according to claim 11, wherein a reflection enhancing film is provided on the totally reflecting surface of the high beam condenser and/or the upper surface of the high beam condenser.

15. The vehicle lamp module according to claim 11, wherein an antireflection film is provided on the light exiting surface of the high beam condenser.

16. The vehicle lamp module according to claim 11, wherein the upper surface of the high beam condenser is subjected to aluminizing treatment, with an aluminizing reflectivity greater than or equal to 0.8.

17. The vehicle lamp module according to claim 14, further comprising a heat sink, a lens support, and a module support, wherein the lens support is configured such that the lens is mounted thereto, the module support is configured to connect the heat sink and the lens support, and the module support is configured to be connected to a lamp body of the vehicle lamp.

18. The vehicle lamp module according to claim 17, wherein an uneven curved surface or uneven curved surfaces is/are provided on one or both sides of a cooling fin of the heat sink.

19. The vehicle lamp module according to claim 17, wherein the heat sink is provided with a first mounting surface and a second mounting surface, wherein an angle not more than 30° is formed between the first mounting surface and the second mounting surface; the low beam circuit board is mounted on the first mounting surface; and the high beam circuit board is mounted on the second mounting surface.

20. A vehicle, comprising the vehicle lamp module according to claim 1.

* * * * *